US010857554B2

(12) United States Patent
Lee

(10) Patent No.: US 10,857,554 B2
(45) Date of Patent: Dec. 8, 2020

(54) COMPACT CONTAINER INCLUDING PUMP HAVING SHORT STROKE

(71) Applicant: PUM-TECH KOREA CO., LTD, Incheon (KR)

(72) Inventor: Do Hoon Lee, Bucheon-si (KR)

(73) Assignee: PUM-TECH KOREA CO., LTD., Incheon (KR)

( * ) Notice: Subject to any disclaimer, the term of this patent is extended or adjusted under 35 U.S.C. 154(b) by 1071 days.

(21) Appl. No.: 14/837,816

(22) Filed: Aug. 27, 2015

(65) Prior Publication Data

US 2017/0056905 A1 Mar. 2, 2017

(51) Int. Cl.

| | |
|---|---|
| ***A45D 33/02*** | (2006.01) |
| ***B05B 11/00*** | (2006.01) |
| ***A45D 34/00*** | (2006.01) |
| *B05B 1/14* | (2006.01) |

(52) U.S. Cl.

CPC ..... *B05B 11/3001* (2013.01); *A45D 33/025* (2013.01); *A45D 34/00* (2013.01); *B05B 11/3025* (2013.01); *A45D 2200/056* (2013.01); *B05B 1/14* (2013.01); *B05B 11/0032* (2013.01)

(58) Field of Classification Search

CPC .. A45D 33/003; A45D 33/006; A45D 33/008; A45D 33/0025; A45D 33/04; A45D 33/06; A45D 33/16; A45D 33/18; B05B 11/3011

USPC ..... 222/405, 256, 385

See application file for complete search history.

(56) References Cited

U.S. PATENT DOCUMENTS 4,671,432 A * 6/1987 Benecke ..... B67D 7/0205 222/256
2005/0017089 A1* 1/2005 Rohrschneider .... B05B 11/3004 239/333
2012/0305606 A1* 12/2012 Lee ..... A45D 33/02 222/256
2016/0136666 A1* 5/2016 Kang ..... B05B 11/3028 222/182

FOREIGN PATENT DOCUMENTS

KR WO2015/088100 * 6/2015

OTHER PUBLICATIONS

Machine Translation of Kang.*

* cited by examiner

*Primary Examiner* — Rachel R Steitz
*Assistant Examiner* — Brianne E Kalach
(74) *Attorney, Agent, or Firm* — Heedong Chae; Lucem, PC

(57) ABSTRACT

The present invention provides a compact container including a pump having a short stroke distance, which includes a container body 10 formed at one side thereof with a button 11 and a container lid 20 hinge coupled to one side of the container body 10, the compact container including; an inner container 30 formed therein with a content receiving space 31; a pump support plate 40 coupled to a top of the inner container 30 to seal the inner container 30 and provided at a center thereof with a cylinder 51; and a pump 50 installed on a center top part of the pump support plate 40 to pump a content and having a stroke distance of 1.5 mm to 2.5 mm, in which a ratio between the stroke distance and an inner diameter of the cylinder 51 is 1:5 to 1:13.

7 Claims, 6 Drawing Sheets

COMPACT CONTAINER INCLUDING PUMP HAVING SHORT STROKE

BACKGROUND OF THE INVENTION

1. Field of the Invention

The present invention relates to a compact container including a pump having a short stroke distance, and more particularly, to compact container including a pump having a short stroke distance, in which a pump support plate is formed in a plate shape on a top of a container body and a pump is coupled on the pump support plats, the pump includes a piston, a piston ring, a cylinder and a suction valve plate identical to a typical pump, the stroke distance of the pump is reduced to 1.5 mm to 2.5 mm while the ratio of the stroke distance and the inner diameter of the cylinder of the pump is changed from a typical ratio of 1:1 to 1:3 to 1:5.5 to 1:13, so that a content receiving space in the container body is maximised, a bushing is coupled, to a top of the cylinder of the pump, in which an end part of the bushing is formed in a round shape and a gap of 0.3 mm to 1.2 mm is formed between the bashing and an up-down moving member such that the up-down moving member is movable in the bushing, and the stroke distance of the pump is shortened so that the method of pumping a cosmetic product is not limited, to vertically pressing a center part of a discharge plate, but the cosmetic can be easily discharged even when any part of the discharge plate is pressed.

2. Description of the Related Art

Color cosmetics are used for making the appearance beautiful and making the skin beautiful, and is classified as a base make-up used for uniformly making the skin color and covering flaws of the skin, and a point make-up for partially heightening the 3-dimensional effects of the lips, eyes, fingernails and the like. The base make-up includes a make-up base, a foundation, a powder and the like, and the point make-up includes a lipstick, an eyeliner, a mascara and the like.

The foundation is classified as a solid foundation, a liquid foundation and a gel foundation according to the form of the cosmetics, in which the solid foundation has a high covering ability but is lumped when a correction make-up is performed, and the liquid foundation has good adhesiveness, but has a weak sustaining strength. Accordingly, recently, the number of consumers preferring the gel foundation, which has a significant sustaining strength and good adhesiveness when coating the skin, has increased.

Thus, the development of a container for the gel foundation is required. In general, the gel foundation is filled into a glass container or a tube container, and used by a user taking the gel foundation, onto the hand, or squeezing out the gel foundation from the tube and coating the skin by using a puff or the hand.

However, in the prior art, the hand of the user becomes smeared with the cosmetic whenever the user uses the foundation, so the user needs to wash the hands every time, and loss of the cosmetic occur since the hand on which the cosmetic is smeared is washed.

To solve the above mentioned problems, as shown in FIG. 1, the applicant has disclosed Korean Registered Utility Model No. 20-0461424, Compact container having airless pump. In the prior art, a gel cosmetic is filled in a container body and a pump is operated by pressing a button to discharge the gel cosmetic onto a discharge plate, then a puff may be used so that the cosmetic is not smeared on the hand when using the gel cosmetic.

A typical pump 100 includes a cylinder 101, a piston 102, a piston ring 103, a suction valve plate 104, an up-down moving member 105 and a bushing 106.

However, in the prior art, the pump 100 is installed in an inner central part of the container body and is structurally formed in such a manner that the pump makes contact with a bottom surface of the container body, so the pump occupies a large portion inside on the container body and the volume, in which the content receiving space is formed, is reduced, thus the amount, of content accommodated in the container body is reduced and the cosmetic may be used for only a short period of time.

In general, the typical pump 100 used for cosmetic products has a stroke distance of 3.0 mm to 6.3 mm and the ratio between the stroke distance of the pump 100 and the inner diameter of the cylinder 101 may be formed between 1:1 to 1:3. To solve the above mentioned problems, the typical structure, in which the pump is installed inside the container body, is needed to be changed such that the pump is installed on a top of the container body to enlarge the content receiving space in the container body.

In addition, in the typical pump 100, the interval between the up-down moving member 105 and the bushing 106 is tightly formed so that the pump 100 is operated only when the center axis of the piston 102 and the center axis of the cylinder 101 correspond to each other to induce the up-down moving member 105 to move vertically, however, the up-down moving member 105 becomes inclined when the central part of the pump is not pressed when the user operates the pump 100, so the up-down moving member 105 becomes trapped in the bushing 106 and the pump becomes inoperable.

In addition, in the prior art, the center axis of the piston 102 and the center axis of the cylinder 101 are required to align with each other, so when the user presses the discharge plate to discharge the content, the pressing location is limited, thus the user is required to vertically press the central part of the discharge plate to pump the cosmetic, so the pump is inconvenient to use.

SUMMARY OF THE INVENTION

The present invention is provided to solve the above mentioned problems, and an object is to provide a compact container including a pump having a short stroke distance, in which a pump support plate is formed in a plate shape on a top of a container body and the pump is coupled on the pump support plate, the pump includes a piston, a piston ring, a cylinder and a suction valve plate identical to a typical pump, the stroke distance of the pump is reduced to 1.5 mm to 2.5 mm while the ratio of the stroke distance and the inner radius of the cylinder of the pump is changed from a typical ratio of 1:1 to 1:3 to 1:5.5 to 1:13, so that a content receiving space in the container body is maximised.

In addition, an object is to provide a compact container including a pump having a short stroke distance, in which a bushing is coupled to a top of the cylinder of the pump, an end part of the bushing is formed in a round shape and a gap of 0.3 mm to 1.2 mm is formed between the bushing and an up-down moving member such that the up-down moving member is movable in the bushing, and the stroke distance of the pump is shortened so that a method of pumping a cosmetic product is not limited to vertically pressing a center part of a discharge plate, but the cosmetic can foe easily discharged even when any part of the discharge plate is pressed.

The present invention provides a compact container including a pump having a short stroke distance, which includes a container body 10 provided at one side thereof with a button 11 and a container lid 20 hinge coupled to one side of the container body 10 to open and close the container body 10, the compact container including; an inner container 30 formed therein with a content receiving space 31; a pump support, plate 40 coupled to a top of the inner container 30 to seal the inner container 30 and provided at a center thereof with a cylinder 51; and a pump 50 installed on a center top part of the pump support plate 40 to pump a content and having a stroke distance of 1.5 mm to 2.5 mm in which a ratio between the stroke distance and an inner diameter of the cylinder 51 is 1:5 to 1:13.

In addition, a discharge plate 60 may be provided on an upper side of the pump 50 and formed with a plurality of multiple discharge holes 61.

Further, the pump 50 may include: a cylinder 51 provided on a center upper side of the pump support plate 40 and formed at a bottom surface thereof with a content suction hole 58; a suction valve plate 52 mounted on the bottom surface of the cylinder 51 to selectively open and close the content suction hole 58; a bushing 53 coupled to an external side of the cylinder in such a manner that the hushing 53 is seated on an upper end of the cylinder 52; a piston 55 provided at an inner side of the cylinder 51; a piston ring 56 fitted around an outer side of the piston 55 to make close contact with an inner side surface of the cylinder 51; an up-down moving member 57 coupled to an inner circumferential surface of the piston 55 to move up and down; and an elastic member 54 to elastically support the up-down moving member 57.

In addition, the up-down moving member 57 is provided at a center lower side thereof with an inner extension wheel 571, which extends to be coupled to the piston 55, and an outer extension wheel 572 which extends while being spaced apart from an outer side of the inner extension wheel 571 by a predetermined distance so as to be fitted around an outer side of the piston ring 56.

Further, a through hole 531, through which an outer extension wheel 572 of the up-down moving member 57 passes through, may be formed at a center of the bushing 53, and an inner peripheral part 532 extends in the through hole 531 may be formed. Multiple elastic member receiving parts 533 may be formed at an outer side of the through hole 531, and an outer peripheral part 534 inserted into the pump support plate 40 is formed at an outer side of the elastic member receiving part 533.

In addition, an inner end part of the inner peripheral part 532 of the bushing 53 may have a round shape.

Further, a gap 59 of 3.0 mm to 1.2 mm may be formed between the inner peripheral part 532 of the bushing 53 and the outer extension wheel 572 of the up down moving member 57 such that the up-down moving member 57 is movable in the bushing 53.

In addition, a distribution plate 70 may be further formed on an upper side of the pump 50.

Further, a content diffusion flow path 71 may be formed at an upper surface of the distribution plate 70 to diffuse the discharged content, and a pair of half-circle protrusions 72 may be formed at an outer border of the distribution plate 70, In addition, a button member 80 in a ring shape may be further formed on an upper side of the distribution plate 70.

Further, a pressing button 81 may protrude outward from an upper part of one side of the button member 80, a hook 82 may be formed at an outer side of an opposite side of the pressing button 81, and a pair of half-circle grooves 83 may be formed at a position vertical to a direction to which the pressing button 81 and the hook 82 are coupled.

In addition, the half-circle protrusion 72 and the half-circle groove 83 are formed in a half-circle shape, the half-circle protrusion 72 is inserted into the half-circle groove 83, and the diameter of the half-circle protrusion 72 is formed smaller than the diameter of the half-circle groove 83.

The present invention is provided to solve the above mentioned problems, and an object is to provide a compact container including a pump having a short stroke distance, in which a pump support plate is formed in a plate shape on a top of a container body and a pump is coupled on the pump support plate, the pump including a piston, a piston ring, a cylinder and a suction valve plate identical to a typical pump, the stroke distance of the poop is reduced to 1.5 mm to 2.5 mm while the ratio of the stroke distance and the inner radius of the cylinder of the pump is changed from a typical ratio of 1:1 to 1:3 to 1:5.5 to 1:13, so that a content receiving space in the container body is maximized.

In addition, an object is to provide a compact container including a pump having a short stroke distance, in which a bushing is coupled to a top of the cylinder of the pump, an end part of the bushing is formed in a round shape and a gap of 0.3 mm to 1.2 mm is formed between the bushing and an up-down moving member such that the up-down moving member fluidly moves in the bushing, and the stroke distance of the pump is shortened so that a method of pumping a cosmetic product is not limited to vertically pressing a center part of a discharge plate, but the cosmetic can be easily discharged even when any part of the discharge plate is pressed.

DETAILED DESCRIPTION OF THE INVENTION

A compact container including a pump having a short stroke distance according to the embodiment of the present invention will be described in detail with reference to the accompanying drawings.

Figure 1:
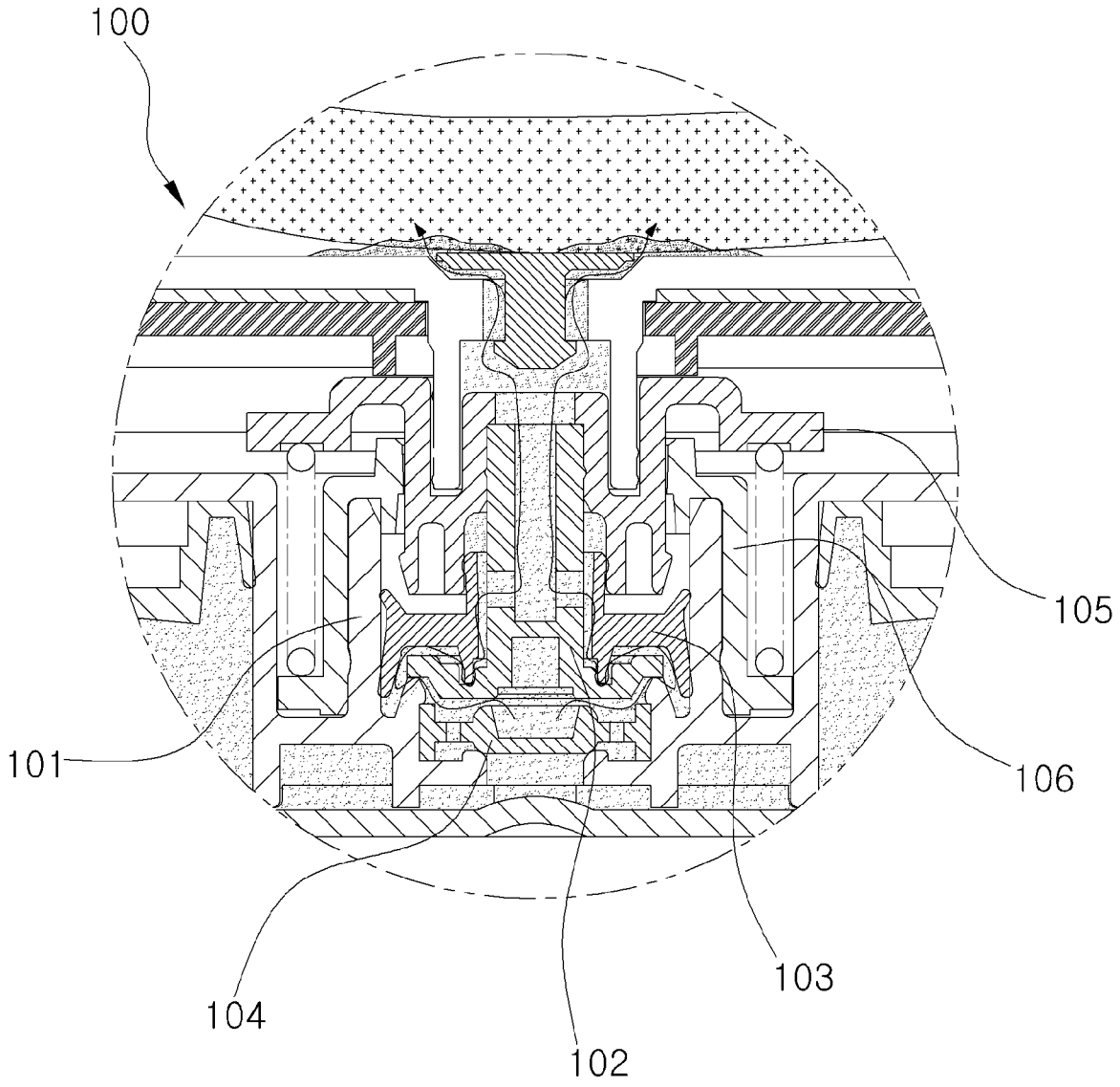
FIG. 1 is a view showing a compact container having an airless pump.
Figure 2:
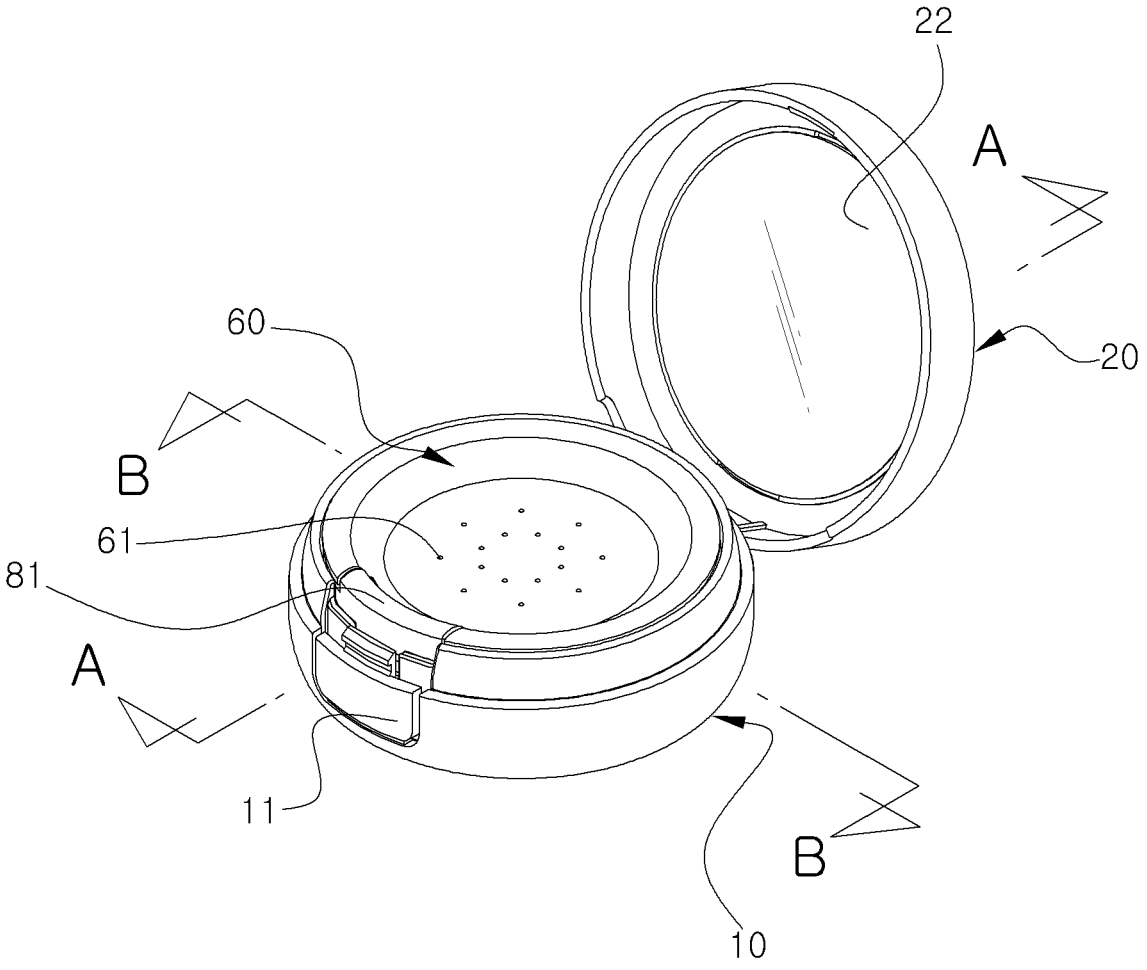
FIG. 2 is a perspective view showing a compact container including a pump having a short, stroke distance according to the present invention.
Figure 3:
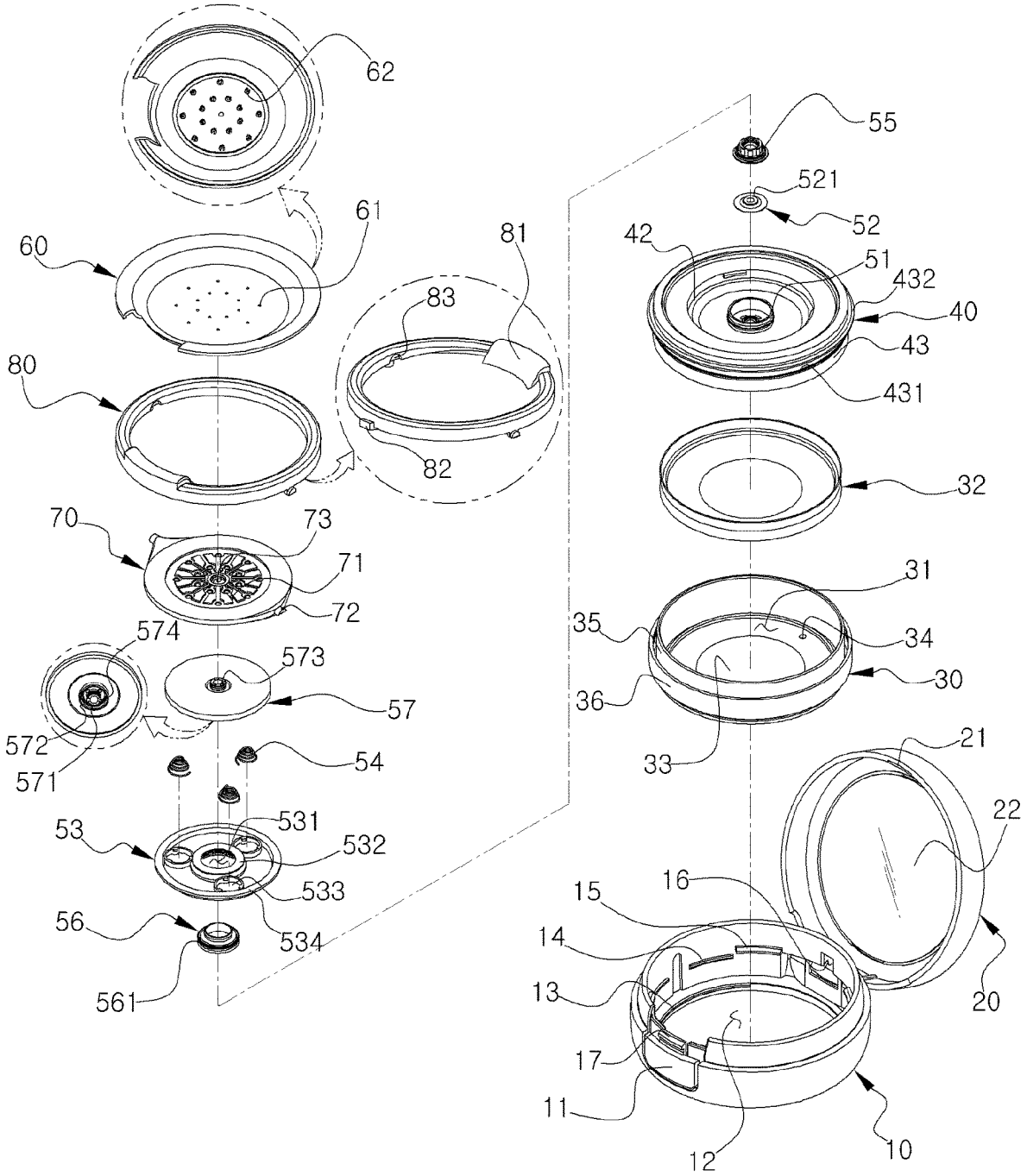
FIG. 3 is an exploded perspective view showing the compact container including a pump having a short stroke distance according to the present invention.
Figure 5:
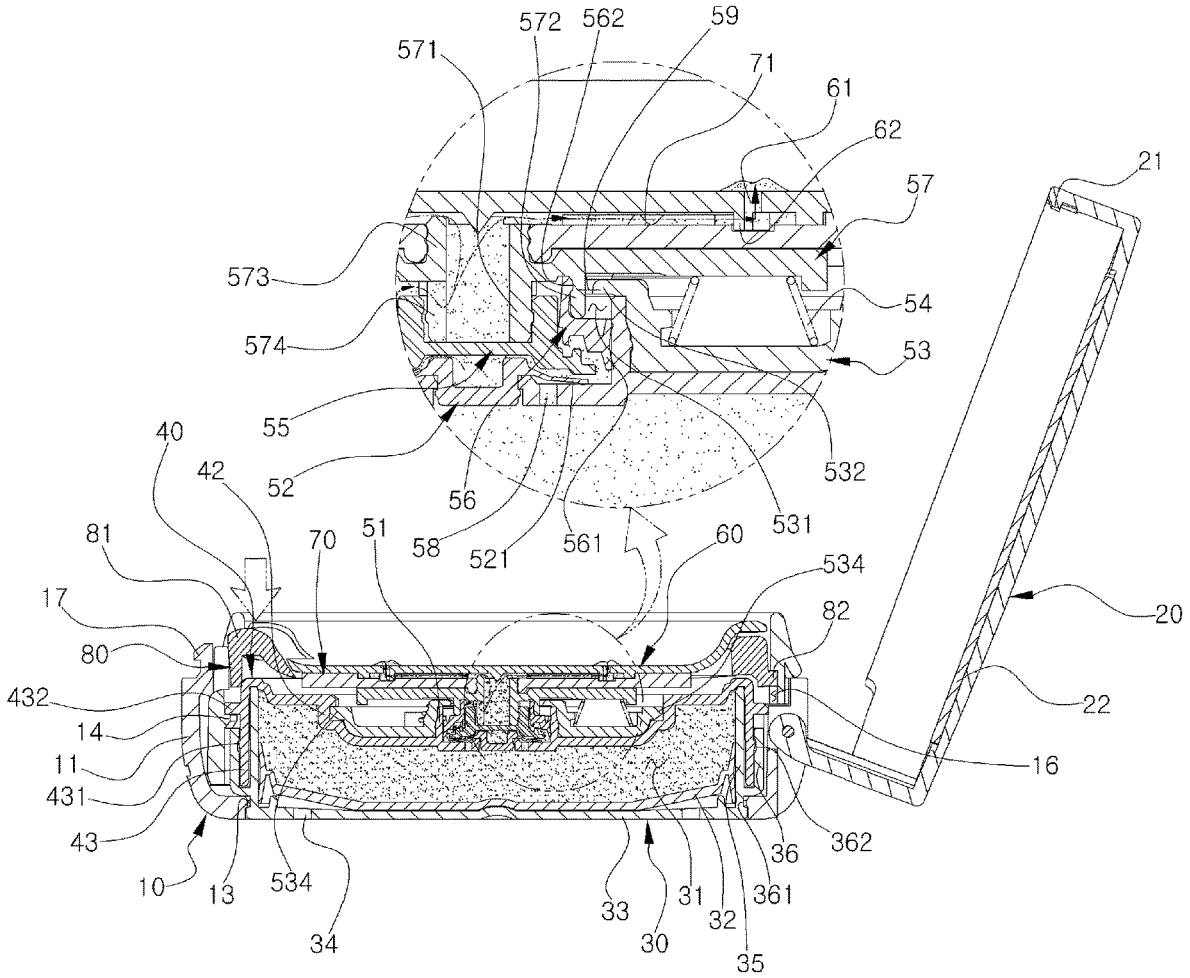
FIG. 5 is a sectional view showing the compact container including a pump having a short stroke distance according to the present invention in a pressed state.
Figure 6:
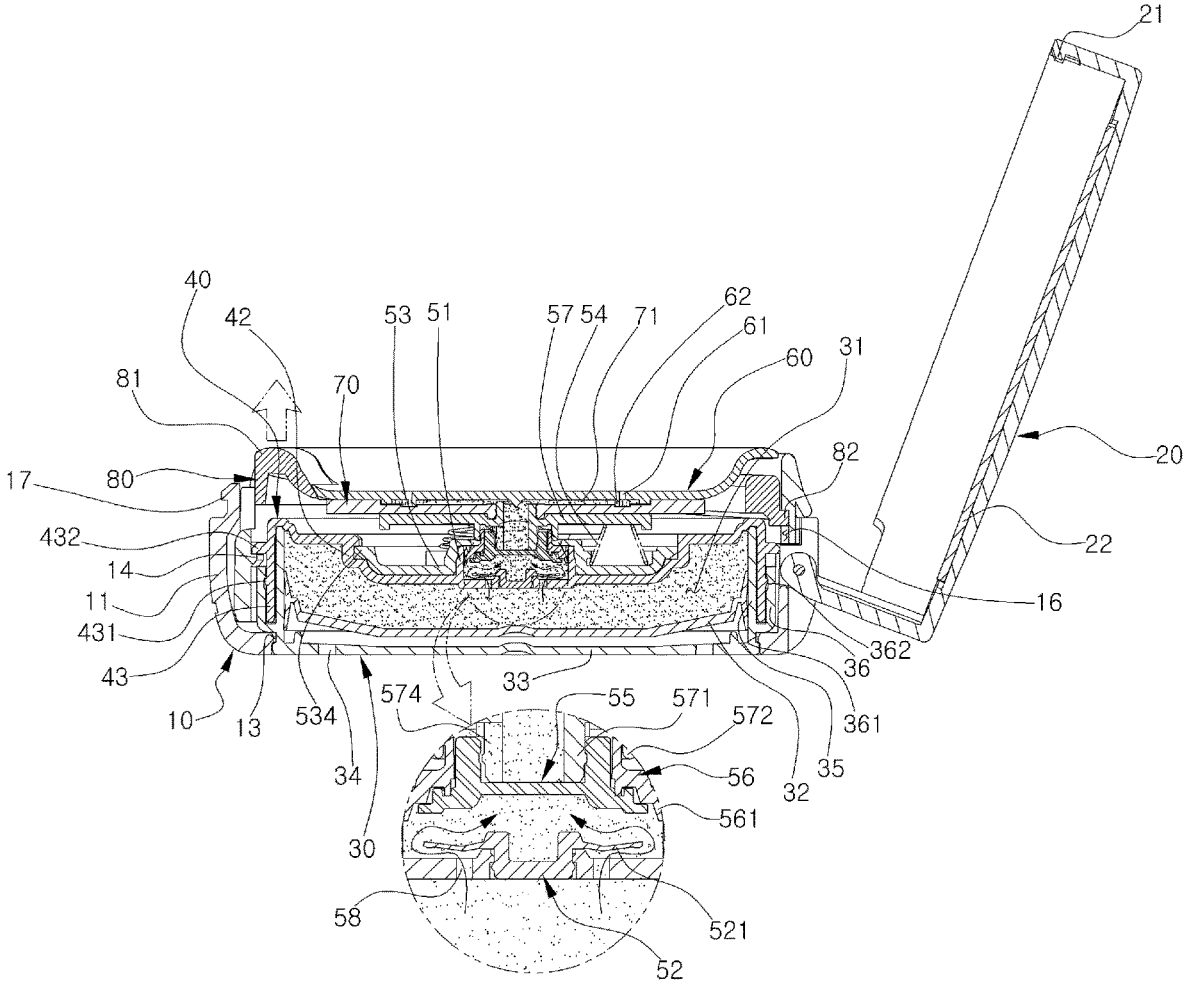
FIG. 6 is a sectional view showing the compact container including a pump having a short stroke distance according to the present invention, in which the pressed state is released.

FIG. 2 is a perspective view showing a compact container including a pump having a short stroke distance according to the present invention. FIG. 3 is an exploded perspective view showing the compact container including a pump having a short stroke distance according to the present invention, FIG. 4 is a sectional view showing the compact container including a pump having a short, stroke distance according to the present invention, FIG. 5 is a sectional view showing the compact container including a pump having a short stroke distance according to the present invention in a pressed state, and FIG. 6 is a sectional view showing the compact container including a pump having a short stroke distance according to the present invention, in which the pressed state is released.

Figure 4:
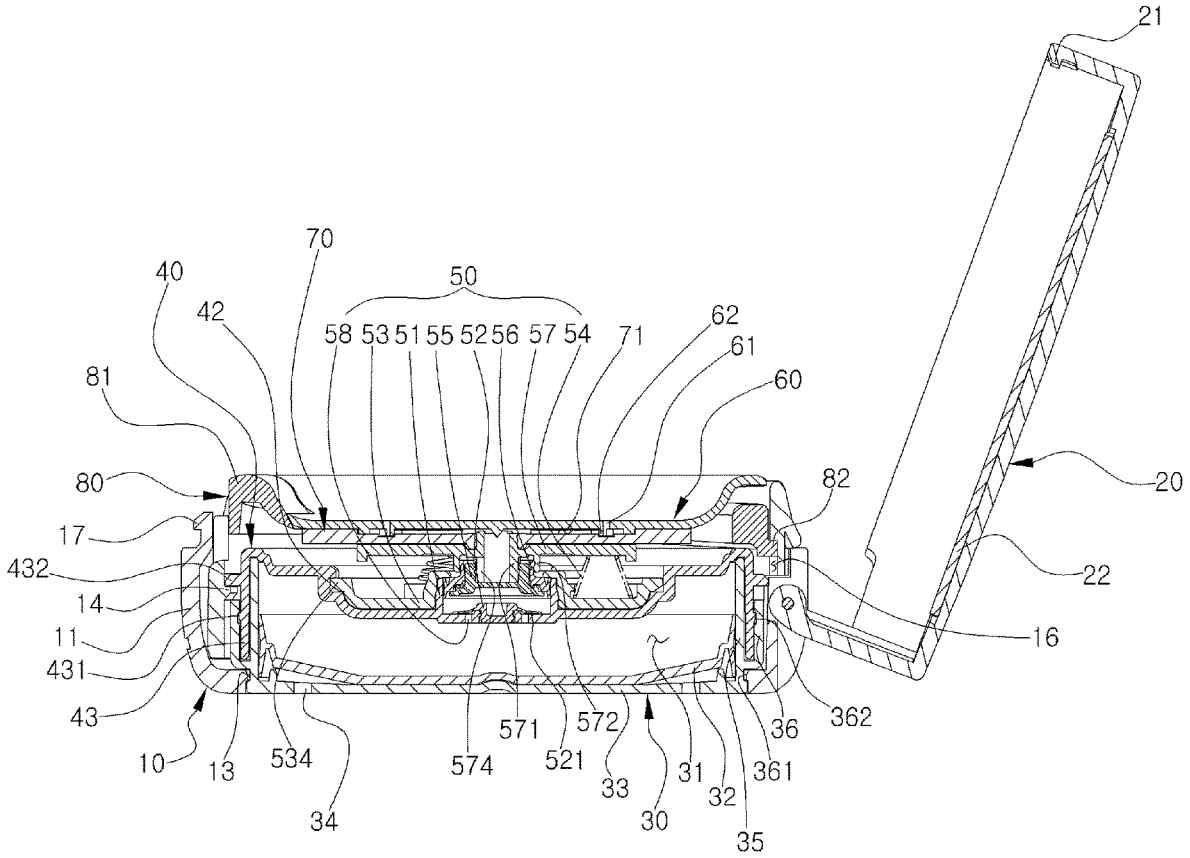
FIG. 4 is a sectional view showing the compact container including a pump having a short stroke distance according to the present invention.

A compact container including a pump having a short stroke distance according to the embodiment of the present invention, as shown in FIGS. 3 and 4, which includes a container body 10 provided at one side thereof with a button 11 and a container lid 20 hinge coupled to one side of the container body 10 to open and close the container body 10, includes; an inner container 30 formed therein with a content receiving space 31; a pump support plate 40 coupled to a top of the inner container 30 to seal the inner container and provided at a center part thereof with a cylinder 51; and a pump 50 installed on a center top part of the pump support plate 40 to pump a content and having a stroke distance of 1.5 mm to 2.5 mm in which a ratio between the stroke distance and an inner diameter of the cylinder 51 is 1:5 to 1:13.

An inner container receiving space 12 is formed in the container body 10 to receive the inner container 30, and a first mounting step 13 and second and third mounting steps 14 and 15 formed on an upper side of the first mounting step 13 and spaced apart from each other in a predetermined distance are formed at an inner side surface of the container body 10. In addition, a hook coupling groove 16 is formed at an inner side surface of the container body 10 at a position corresponding to the button 11.

The button 11 is integrally formed at one side of the container body 10, and a locking protrusion 17, which easily retracts by a push operation of a user, protrudes from an upper side of the button 11.

The container lid 20 opens and closes the container body 10, a hook 21 having a protrusion shape is formed at one side of the container lid 20 at a position corresponding to a locking protrusion of the container body 10, such that the hook 21 is fastened to the locking protrusion 17 of the container body 10.

In addition, a mirror 22 is provided at an inner side of the container lid 20 so that a user may easily wear make-up.

A bottom plate 32 is formed at an inner side of the inner container 30 to push the content upward, and the bottom plate 32 makes close contact with an inner side surface of the inner container 30.

The inner container 30 includes an inner container bottom surface 33, an inner wall 35 extending upward from the inner container bottom surface 33 and an outer wall 36 spaced apart from the inner wall 35 to the outside in a predetermined interval.

A mounting groove 361 is formed at an outer circumference of the outer wall 36 of the inner container 30 and is coupled to the first mounting step 13 of the container body 10 and a coupling groove 362 is formed at an inner circumference of the outer wall 36.

In addition, an air circulation hole 34, through which outside air flows in, is formed at the inner container bottom surface 33 of the inner container 30.

The pump support plate 40 is formed in a plate shape and is coupled to a top part of the inner container 30 to seal the inner container 30.

A cylinder 51 is integrally formed at a center of the pump support plate 40, a bushing coupling groove 42, to which a bushing 53 of the pump is coupled, is formed at an outer side of the cylinder 51 and a lower extension wheel 43 extends downward from an outer side of the bushing coupling groove 42.

A coupling protrusion 431 is formed at an outer circumference of the lower extension wheel 43 of the pump support plate 40 such that the coupling protrusion 431 is coupled to the coupling groove 362 of the inner container 30, and a mounting wheel 432 protrudes from an upper side of the coupling protrusion 431 and is inserted between the second and third mounting steps 14 and 15 of the container body 10.

The pump 50 pumps the content and, as in the typical pump, includes a cylinder 51, a suction valve plate 52, a piston 55 and a piston ring 56, however, different from the typical pump, the pump 50 is installed at an upper part of the pump support plate 40 to maximize the area of the content receiving space 31, the stroke distance is 1.5 mm to 2.5 mm, and the ratio of the stroke distance and the inner diameter of the cylinder 51 is 1:5 to 1:13, so the stroke distance of the pump 50 is significantly shorter and the inner diameter of the cylinder 51 is formed larger than the typical pump.

The ratio of the stroke distance of the typical pump and the inner diameter of the cylinder is shown in Table 1 as below,

TABLE 1

| Pump stroke distance (mm) | Cylinder diameter (mm) | Ratio | Discharge amount (cc) |
|---|---|---|---|
| 6.3 | 7.2 | 1:1.143 | 0.256 |
| 5.8 | 8.4 | 1:1.448 | 0.321 |
| 5.2 | 7.6 | 1:1.462 | 0.236 |
| 4 | 7.66 | 1:1.915 | 0.184 |
| 3.0 | 9.0 | 1:3 | 0.191 |
| 3.2 | 9.7 | 1:3.031 | 0.236 |

As shown in Table 1, the typical pump has the stroke distance of 3.0 mm to 6.3 mm, and the ratio of the stroke distance of the pump and the inner diameter of the cylinder of 1:1 to 1:3, so, when the typical pump is employed to a container such as a compact container having a short vertical length and a long transverse length, the typical pump is accommodated in the content receiving space formed in the container body thereby occupying a large area of the content receiving space.

To solve the above described problems, in the compact container including a pump having a short stroke distance according to the present invention, the stroke distance of the pump 50 is reduced to 1.5 mm to 2.5 mm to maximize the inner diameter of the cylinder 51, the ratio of the stroke distance and inner diameter of the cylinder 51 is changed to 1:5 to 1:13 and the pump 50 is installed at an upper part of the pump support plate 49 in a plate shape, so that the content receiving space 31 of the inner container 30 may be maximally utilized.

The pump 50 may include; the cylinder 51 provided on a center upper side of the pump support plate 40 and formed at a bottom surface thereof with a content suction hole 58; the suction valve plate 52 mounted on the bottom surface of the cylinder 51 to selectively open and close, the content suction hole 58; the bushing 53 coupled to the outer side of the cylinder in such a manner that the bushing 53 is seated on the upper end of the cylinder 51; the elastic member 54 mounted on the upper part of the bushing 53 or the pump support plate 40 to elastically support the up-down moving member 57; the piston 55 provided at the inner side of the cylinder 51; the piston ring 56 making close contact with the inner side surface of the cylinder 51; and the up-down moving member 57 coupled to the inner circumferential surface of the piston 55 to move up and down.

The up-down moving member (57) is provided at a center lower side thereof with an inner extension wheel (571), which extends to be coupled to the piston (55), and an outer extension wheel (572) which extends while being spaced apart from an outer side of the inner extension wheel (571) by a predetermined distance so as to be fitted around an outer side of the piston ring (56).

In addition, an upper extension wheel 573, to which a distribution plate 70 is coupled, extends from the center upper side of the up-down moving member 57.

Multiple slits 574 (small gaps), through which the pumped content pass through, are formed on an outer circumference of the inner peripheral wheel 571 of the up-down moving member 57.

A through hole 531, through which an outer extension wheel 572 of the up-down moving member 57 passes through, may be formed at a center of the bushing 53, and an inner peripheral part 532 extends in the through hole 531 may be formed. Multiple elastic member receiving parts 533 may be formed at an outer side of the through hole 531, and an outer peripheral part 42 inserted into a bushing coupling groove 42 of the pump support plate 40 is formed at an outer side of the elastic member receiving part 533.

An inner end part of the inner peripheral part 532 of the bushing 53 may have a round shape.

In addition, a gap 59 of 3.0 mm to 1.2 mm may be formed between an inner peripheral part 532 of the bushing 53 and an outer extension wheel 572 of the up-down moving member 57 such that the up-down moving member 57 is movable in the bushing 53.

In other words, the cop part of the piston ring 56 of the pump 50 spreads outward, a close contact wheel 562 is formed at an outer side of an upper end of the piston ring 56 such that the outer side of the upper part of the piston ring 56 makes close contact and is inserted into the outer extension wheel 572 of the up-down moving member 57, and a piston blade 561 of the piston ring 56 makes close contact with an inner side surface of the cylinder 51, so that, even when the up-down moving member 57 is pressed while being inclined to one side, the inside of the cylinder 51 is sealed by the piston ring 56 so the pump 50 operates normally.

Therefore, even when the user does not vertically press the center part of the discharge plate 60 and presses a part deviated from the center part such that the up-down moving member 57 becomes inclined, the piston ring 56 in the cylinder 51 operates normally thereby easily pumping the content.

A discharge plate 60, on which multiple discharge holes 61 are formed, is provided on an upper side of the pump 50, and a discharge wheel 62, in which one side of an outer circumference is opened so that the content may pass through, is formed at a lower side of the discharge hole 61.

A distribution plate 70 may be further formed on an upper side of the pump 50.

A content diffusion flow path 71 is formed on a upper surface of the distribution plate 70 such that the content is diffused, a pair of half-circle protrusions 72 are formed at an outer boundary of the distribution plats 70, and a coupling hole 73, into which the upper extension wheel 573 of the up-down moving member 57 is inserted; is formed at a center part of the distribution plate 70.

A button member 50 in a ring shape may be further formed on an upper side of the distribution plate 70.

A pressing button 81 may protrude outward from an upper part of one side of the button member 80, a hook 82 may be formed at an outer side of an opposite side of the pressing button 81, and a part of half-circle grooves 83 may be formed at a position, vertical to a direction, in which the pressing button 81 and the hook 82 is coupled.

The half-circle protrusion 72 and the half-circle groove 83 are formed in a half-circle shape, and the half-circle protrusion 72 is inserted into the half-circle groove 83.

The diameter of the half-circle protrusion 72 is formed smaller than that of the half-circle groove 33, so when the user presses the pressing button 61 to discharge the content, even if the button member 80 is pressed in an inclined state, the half-circle groove 82 of the button member 80 rotates idle on the upper part of the half-circle protrusion 72 of the distribution plate 70 and changes the pressed center so that the distribution plate 70 may vertically press the up-down moving member 57 of the pump 50.

A method of assembling the compact container including a pump having a short stroke distance configured as above will be described below.

To assemble the compact container including a pump having a short stroke distance according to the present invention, as shown in FIG. 4, the inner container 30 is mounted in the container body 10, to which the container lid 20 is hinge coupled at one side.

Then, the bottom plate 32 is inserted into the inner container 30, the content is inserted and the pump support plate 40 is coupled to the upper part of the inner container 30, in which the lower extension wheel 43 of the pump support plate 40 is inserted between the inner and outer walls 35 and 36 of the inner container 30 while the mounting wheel 432 of the lower extension wheel 43 is inserted into the second and third mounting steps 14 and 15 of the container body 10.

Then, the pump 50 is installed on the top of the pump support plate 40, the distribution plate 70 is coupled to the upper part of the up-down moving member 57 of the pump 50, and the button member 80 is mounted on the upper part of the distribution plate 70, in which positions of the half-circle protrusion 72 of the distribution plate 70 and the half-circle groove 83 of the button member 80 is aligned to mount the button member 80 onto the upper part of the distribution plate 70 while the hook 82 of the button member 80 is inserted into the hook coupling groove 16 of the container body 10.

Lastly, the distribution plate 60 is attached to the upper side surface of the distribution plate 70 to complete the assembly of the compact container including a pump having a short stroke distance according to the present invention.

The usage of the compact container including a pump having a short stroke distance assembled by the method described above will be described.

To use the compact container including a pump having a short stroke distance according to the present, invention, as shown in FIG. 5, the pressing button 81 of the button member 80 is pressed or the top surface of the discharge plate 60 is pressed.

When the pressing button 81 or the discharge plate 60 is pressed, the button member 80 becomes inclined and moves downward, and the discharge plate 70 mounted on the lower side of the button member 80 moves downward with the button member 80, in which, because the diameter of the half-circle protrusion 72 is formed smaller than the diameter of the half-circle groove 83 of the button member 80, even when the button member 80 is pressed in the inclined state, the half-circle groove 83 of the button member 80 is pressed from the upper part of the half-circle protrusion 82 of the distribution plate 80 so that the pump 50 of the distribution plate 70 vertically presses the up-down moving member 57.

By the downward movement of the up-down moving member 57, the piston 55 and the piston ring 56 coupled to the lower side of the up-down moving member 57 move downward with the up-down moving member 57, such that the volume inside the cylinder may be reduced. Accordingly, a pressure is generated inside the cylinder 51, and the content in the cylinder 51 is discharged to the outside due to the pressure so discharge pressure is generated such that the suction valve plate 52 closes the content suction hole 58 formed through the bottom surface of the cylinder 51.

Simultaneously, the content accommodated in the cylinder 51 moves out between the piston 55 and the piston ring 56, passes through the slit 574 of the up-down moving member 57, passes through the diffusion flow path 71 of the distribution plate 70 and discharged through the discharge hole 61 of the discharge plate 60.

Then, when the pressure applied to the pressing button 81 is released, as shown in FIG. 6, the up-down moving member 57 moves upward by the elasticity of the elastic member 54 elastically supporting the up-down moving member 57. In addition, the piston 55 and the piston ring 56 coupled to the lower side of the up-down moving member 57 move upward with the up-down moving member 57, so the volume in the cylinder becomes larger thereby creating a vacuum pressure.

By the vacuum pressure created in the cylinder 51, the suction valve blade 521 of the suction valve plate 52 is lifted such that the content suction hole 53 formed through the bottom surface of the cylinder 51 is opened. Accordingly, the content accommodated in the inner container 30 flows into the cylinder through the content suction hole 58 while the bottom plate 32 installed in the inner container 30 is moved upward.

While the compact container including a pump having a short stroke distance of present invention has been particularly shown and described by embodiments with reference to the accompanied drawings, it should not be interpreted in any way to limit the scope of the present invention. Therefore, the scope of the present invention is not limited to the described embodiments, but is limited only by the accompanying claims and equivalents thereof, and any alterations equivalent to the accompanying claims are within the scope of the present invention.

What is claimed is:

1. A compact container comprising:

an inner container (30) formed therein with a content receiving space (31);

a pump support plate (40) coupled to a top of the inner container (30) to seal the inner container and provided at a center thereof with a cylinder (51);

a pump (50) installed on a center top part of the pump support plate (40) to pump a content and having a stroke distance of 1.5 mm to 2.5 mm, in which a ratio between the stroke distance and an inner diameter of the cylinder (51) is 1:5 to 1:13, wherein the pump (50) comprises:

the cylinder (51) provided on a center upper side of the pump support plate (40) and formed at a bottom surface thereof with a content suction hole (58) that descends downwardly towards the content receiving space (31);

a suction valve plate (52) mounted on the bottom surface of the cylinder (51) to selectively open and close the content suction hole (58);

a bushing (53) coupled to an outer side of the cylinder in such a manner that the bushing (53) is seated on an upper end of the cylinder (51);

a piston (55) provided at an inner side of the cylinder (51);

a piston ring (56) fitted around an outer side of the piston (55) to make close contact with an inner side surface of the cylinder (51);

an up-down moving member (57) coupled to an inner circumferential surface of the piston to move up and down; and an elastic member (54) to elastically support the up-down moving member (57), wherein the suction valve plate (52) rests above the content receiving space (31), wherein a gap (59) of 3.0 mm to 1.2 mm is formed between an inner peripheral part (532) of the bushing (53) and an outer extension wheel (572) of the up-down moving member (57) such that the up-down moving member (57) is movable in the bushing (53), and wherein an inner end part of the inner peripheral part (532) of the bushing (53) has a round shape.

2. The compact container of claim 1, further comprising a discharge plate (60) provided on an upper side of the pump (50) and formed with a plurality of discharge holes (61).

3. The compact container of claim 1, wherein the up-down moving member (57) is provided at a center lower side thereof with the inner extension wheel (571), which extends to be coupled to the piston (55), and the outer extension wheel (572) which extends while being spaced apart from an outer side of the inner extension wheel (571) by a predetermined distance so as to be fitted around an outer side of the piston ring (56).

4. The compact container of claim 1, wherein a through hole (531), through which the outer extension wheel (572) of the up-down moving member (57) passes through, is formed at a center of the bushing (53), and an inner peripheral part (532) extends in the through hole (531).

5. The compact container of claim 4, wherein a close contact wheel (562) is formed at an upper end of an outer side of the piston ring (56).

6. The compact container of claim 1, wherein a top part of the piston ring (56) spreads outward, an outer side of the top part of the piston ring (56) is closely inserted into an inner side of the outer extension wheel (572) of the up-down moving member (57), and a piston blade (561) of the piston ring (56) makes close contact with an inner side surface of the cylinder (51), so that an inside of the cylinder (51) is sealed by the piston ring (56) even when the up-down moving member (57) is pressed while being inclined to one side, whereby normally operating the pump (50).

7. The compact container of claim 1, wherein a close contact wheel (562) is formed at an upper end of an outer side of the piston ring (56).

* * * * *